US005592895A

United States Patent [19]

Schmidt

[11] Patent Number: 5,592,895

[45] Date of Patent: Jan. 14, 1997

[54] SMALL WATERPLANE AREA HIGH SPEED SHIP

[75] Inventor: Terrence W. Schmidt, Santa Clara, Calif.

[73] Assignee: Lockheed Missiles & Space Company, Inc., Sunnyvale, Calif.

[21] Appl. No.: 200,110

[22] Filed: Feb. 22, 1994

Related U.S. Application Data

[63] Continuation-in-part of Ser. No. 899,525, Jun. 16, 1992, abandoned.

[51] Int. Cl.[6] ..... B63B 1/24

[52] U.S. Cl. ..... 114/274; 114/61

[58] Field of Search ..... 114/61, 68, 274, 114/123, 280, 283, 292, 266, 207, 265

[56] References Cited

U.S. PATENT DOCUMENTS

| | | | |
|---|---|---|---|
| 3,149,601 | 9/1964 | Lang | 114/275 |
| 3,347,197 | 10/1967 | Scherer | 114/280 |
| 3,598,076 | 8/1971 | Saxton | 114/274 |
| 3,693,570 | 9/1972 | Erlykin et al. | 114/274 |
| 4,763,596 | 8/1988 | Yoshida | 114/265 |

FOREIGN PATENT DOCUMENTS

| | | | |
|---|---|---|---|
| 0002988 | 1/1977 | Japan | 114/265 |
| 0002986 | 1/1977 | Japan | 114/265 |
| 0002987 | 1/1977 | Japan | 114/265 |
| 0060788 | 5/1981 | Japan | 114/61 |
| 0139585 | 7/1985 | Japan | 114/265 |

*Primary Examiner*—Edwin L. Swinehart
*Attorney, Agent, or Firm*—Feix & Feix; Henry J. Groth

[57] ABSTRACT

A small waterplane area high speed ship is disclosed which includes a hull structure having a bow portion and a stern portion with the hull being normally supported above the surface of the water when in operation. A forward set of dual struts depend from the bow portion of the hull structure; these dual struts are subtended by a first transverse displacement foil extending laterally between amd connected to each of the dual struts. A second set of aft dual struts depend from the stern portion of the hull structure; the second set of dual struts are subtended by a second transverse displacement foil extending laterally between and connected to each of said struts. The transverse displacement foils provide the major bouyancy for the ship during operation to maintain the hull above the surface of the water during operation. The forward and aft struts and the foils are spaced longitudinally a predetermined distance selected such that the transverse wave created by each corresponding element is 180° apart.

39 Claims, 14 Drawing Sheets

SHIP SPEED VS. WATERLINE LENGTH

SMALL WATERPLANE AREA HIGH SPEED SHIP

TECHNICAL FIELD

This application is a continuation-in-part of U.S. patent application Ser. No. 07/899,525, filed Jun. 16, 1992, now abandoned.

FIELD OF THE INVENTION

The present invention relates to displacement ships of the small waterplane area type referred to in the prior art as semi-submerged ships or those ships having a load carrying platform supported by water piercing struts attached to submerged hulls.

BACKGROUND ART

Semi-submerged vessels, which were developed for operation at high sea states, also have been referred to in the prior art as Small Waterplane Area Twin HULL (SWATH) ships. Various configurations of these ships have been described in U.S. Pat. Nos. 3,623,444 and 3,897,744 issued to Thomas G. Lang; U.S. Pat. Nos. 4,552,083 and 4,557,211 issued to Terrence W. Schmidt; and Japanese Patent No. 52,987 issued Jan. 11, 1977.

All previous embodiments of semi-submerged vessels use an arrangement of elongated (small cross-sectional area to length) submerged hulls to provide the majority of the buoyancy. For efficient operation from the standpoint of powering and fuel consumption, SWATH, as with all displacement ships, are presently limited in speeds to those having a Froude number of less than 0.4.

Froude number (F) is defined as follows:

$$F=\frac{v}{\sqrt{gl}}$$

where v=speed g=acceleration due to gravity l=length of hull.

The limit in speed of a displacement ship is best described in *Modern Ship Design,* by Thomas C. Gillmer, 1970 which states, "The practical limiting speed for displacement surface vessels is basically that of wavelength to ship length, where one wavelength, created by the ship, is equal to the ship's waterline length.

This, expressed quantatively, is $V/\sqrt{L}\approx 1.3$ (or F=0.39), and V is sometimes called the hull speed. When a surface ship attempts to exceed this speed it finds itself literally climbing a hill that it is creating. In exceptional cases of slim, highly powered ships such as destroyers, it is possible to exceed this speed, but it is seldom profitable."

The limitation in speed is primarily due to the large increase in wave resistance that occurs between a Froude number of 0.4 and 0.8. This increase in wave resistance is well established in the prior art for all surface displacement ships and is often referred to as the resistance or powering "hump." The hump is referred to as the "primary hump" in this application. See *Fluid-Dynamics Resistance,* by Sighard F. Hoerner, 1965. Because of the high wave resistance, operation in the "hump" speed region results in high propulsion power and inefficient fuel usage. According to Gilmer, supra, "A ship may be required to maintain a constant operational speed for long periods and it is clearly desirable that it should not do so at a hump on the Cw (wave drag) curve" (pg. 160). Normal operation for a displacement ship is at a Froude number corresponding to a "hollow" in the wave drag curve at a Froude number lower than the primary hump. The operational Froude number for various ship types is shown in FIG. 5.22 of Mechanics of Marine Vehicles, Clayton and Bishop, p. 220 and table A page 11–15, Hoerner, supra. Only the destroyer with its abundance of power operates at a Froude number above 0.4.

To delay the onset of high wave making resistance the prior art calls for:

"as long a length as is compatible with other design requirements," Principles of Naval Architecture, Comstock, p. 345;

"greater length will reduce wave-making resistance but increase the frictional resistance," Comstock, p. 342; and "vessels . . . are made as long and slender as practicable," Hoerner, p. 11–12.

Operation at a Froude number greater than 0.8 substantially reduces wave resistance. "The pressure distribution about a high speed vehicle is therefore quite similar to that about a vehicle progressing at a very low speed . . . This means that the wave making resistance of high speed vehicles ($Fr\geqq 1.5$, say) is small as it is for vehicles operating at very low speeds ($Fr\leqq 0.15$, say)" Clayton and Bishop, p. 219; however, to exceed the "hump" speed region requires excessive propulsion power for displacement (including SWATH) ships of the conventional form. The hull speed region at which this large increase in wave resistance occurs as a main or primary hump on the $C_w$ (wave drag) curve so as to result in a requirement for a maximum increase in propulsion power is defined as the "critical hump speed" in this application.

This critical hump speed is illustrated (for displacement ships of conventional design) by the legend "main hump" in the graph of FIG. 20 of the drawings of this application and is the speed at which a peak wave resistance occurs in the plot of wave resistance versus increasing hull speed as illustrated in FIG. 2 of the drawings of this application.

An object of the present invention is to provide a small waterplane area hull form which operates at reduced wave resistance so as to cause the critical hump speed to occur at a low hull speed where the available propulsion thrust is large enough to allow transition through the critical hump speed without excessive installed power and to thereby permit efficient operation to high speeds; that is, where the Froude number is greater than 0.8.

DISCLOSURE OF INVENTION

Counter intuitive to the teachings of the prior art where the reduction in wave resistance is achieved by making the vessel as long as practicable and efficient operation occur in a "hollow" in the wave resistance curve at a Froude number lower than the 0.5 primary hump, the present invention teaches making the vessel (and all components thereof) as short as is practicable and conducting operations at Froude numbers well in excess of the primary hump (Fr>0.8).

According to the present invention, reduction of wave resistance at high speed is achieved by the use of a lower water plane area displacement ship comprised of streamlined struts and streamlined foils extending transversely between the struts. The transverse foils may be integrated into the design. These transverse foils have a significantly reduced stream wise length, when compared to elongated hulls of the conventional design, which effectively increases the Froude number at a given speed. Streamlined pods, also of short length, may be used in conjunction with or may be used in lieu of the streamlined transverse foils.

The ability to reach the high speed, high Froude number operating condition of the present invention is dependent upon the short streamwise lengths and the critical spacing of the hull components. The configuration of the present invention causes the main resistance hump (Fr=0.5) to occur at a low speed where the available propulsion thrust is large thereby allowing transition through the critical hump speed without excessive installed power.

BEST MODE OF CARRYING OUT THE INVENTION

Figure 1:
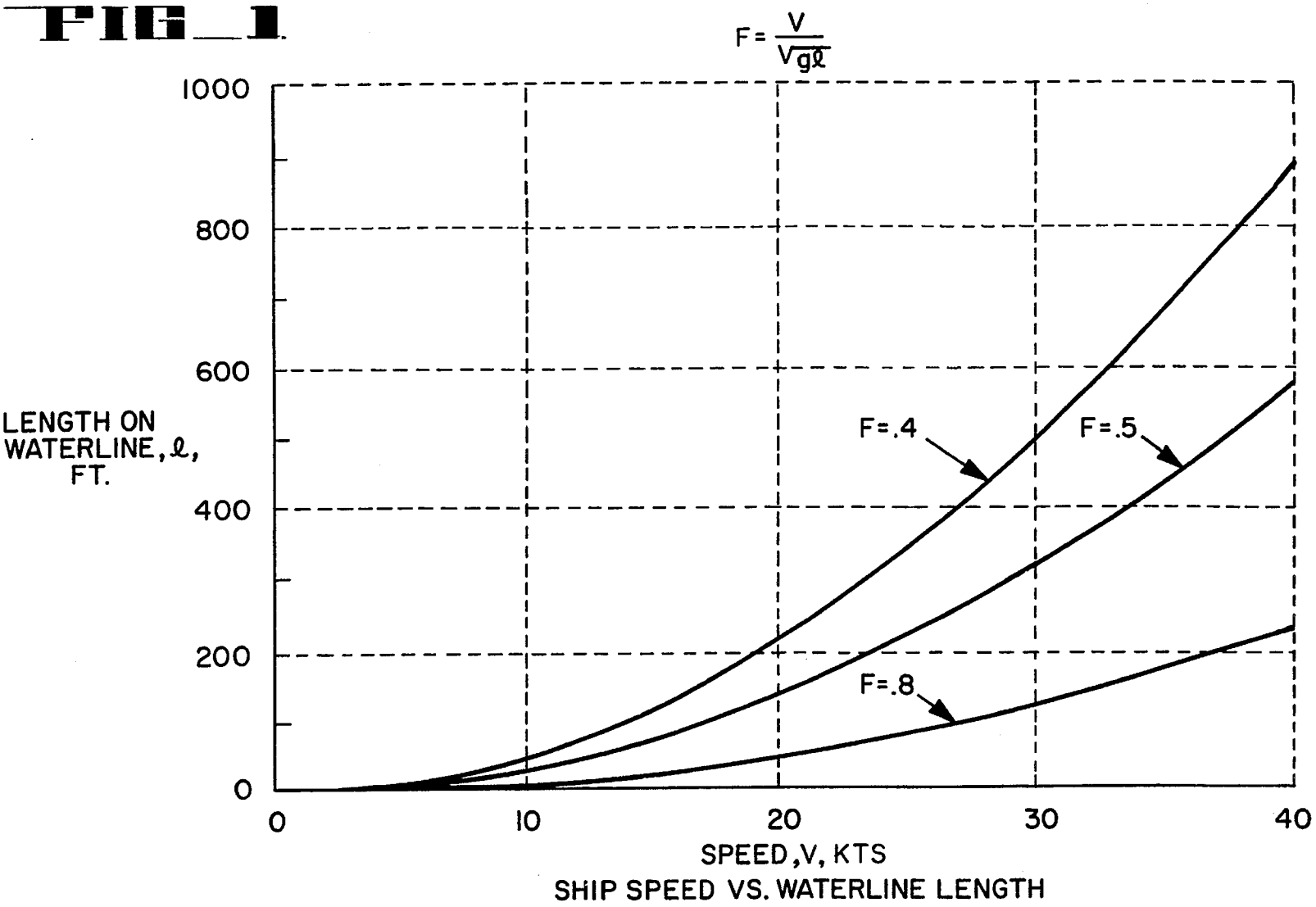
FIG. 1 is a graph showing the relationship between the stream wise length and speed for Froude numbers of 0.4, 0.5, and 0.8.
Figure 2:
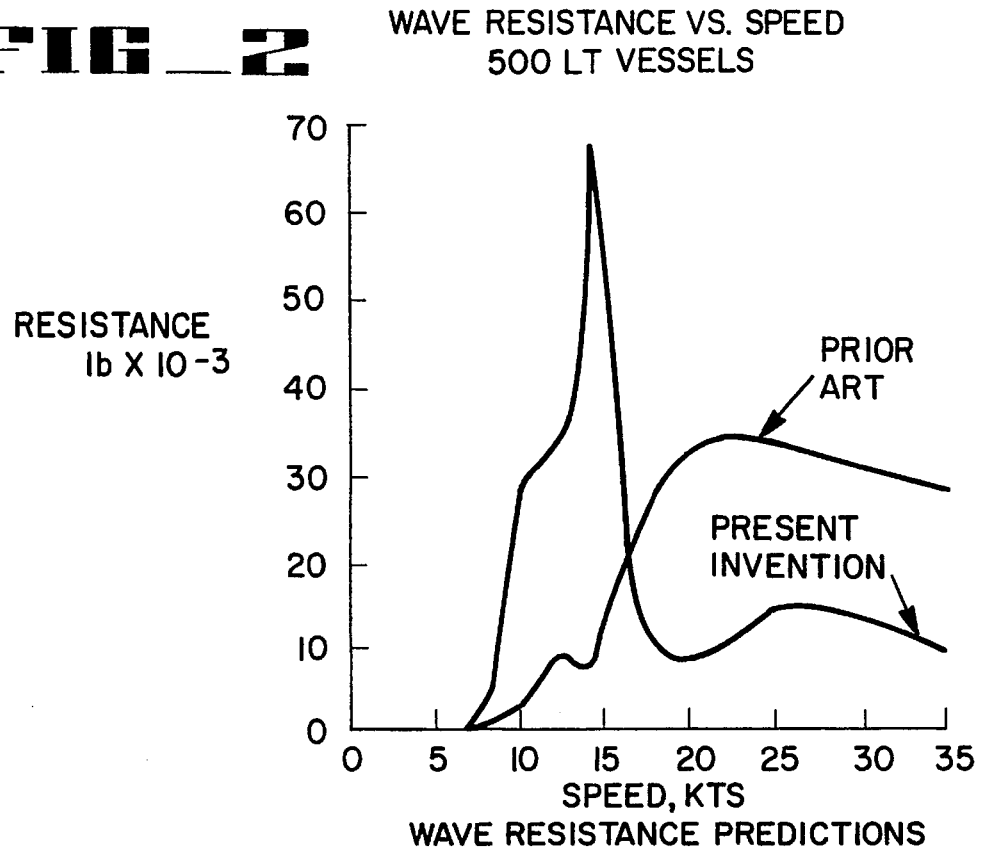
FIG. 2 is a graph illustrating theoretical wave resistance predictions for two 500 long ton vessels; one of conventional SWATH construction embodiment and one constructed according to the present invention.
Figure 3:
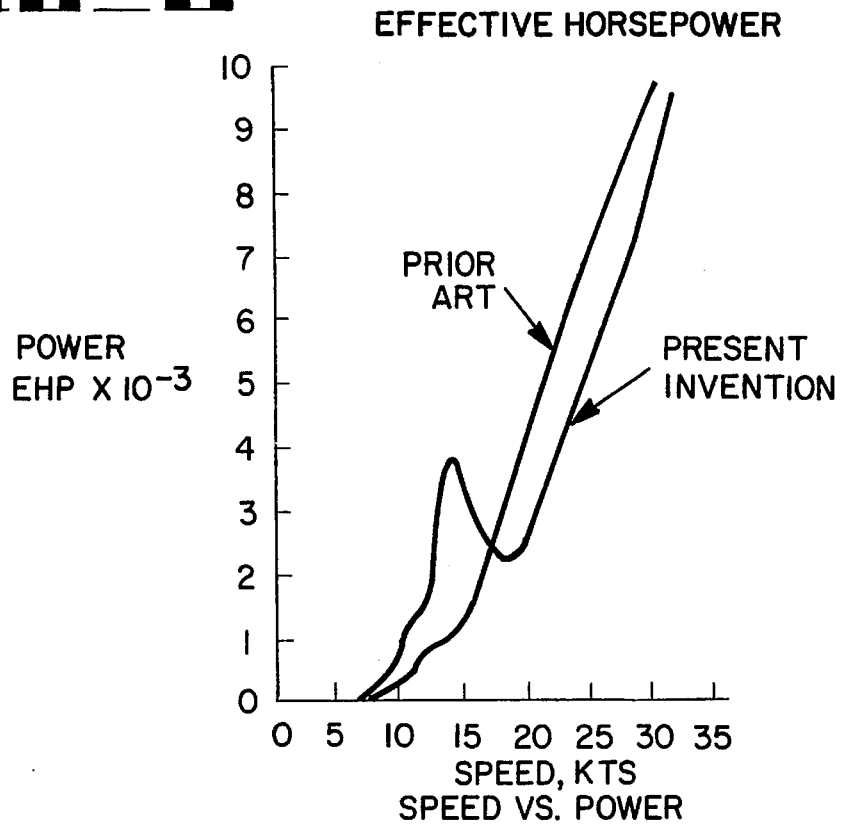
FIG. 3 is a graph illustrating predictions of the total effective horsepower (EHP) required for each ship design represented in FIG. 2; these powering predictions include both residual (wavemaking) and viscous resistance.

The performance advantage details of the present are best understood with reference to FIGS. 1, 2, and 3.

Figure 20:
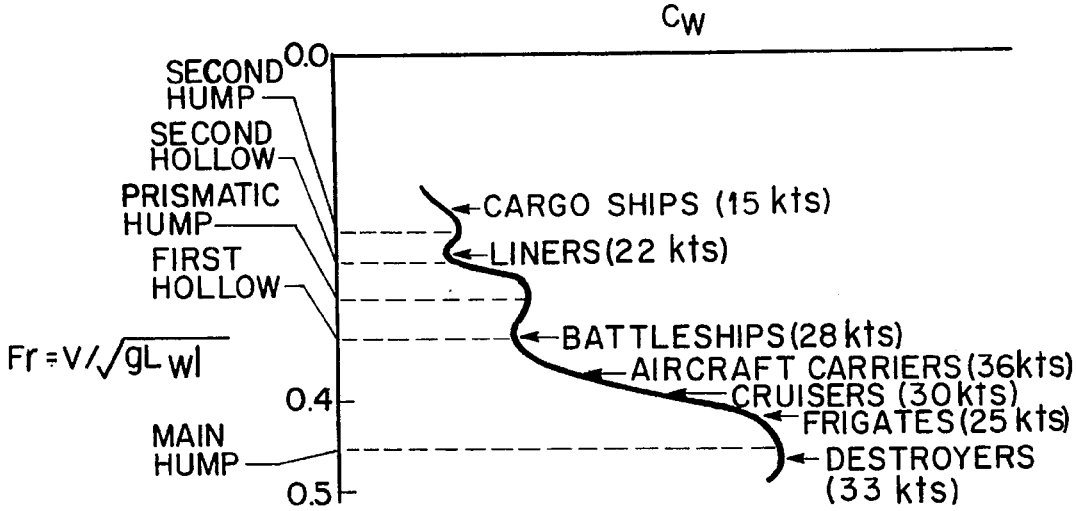
FIG. 20 is a graph illustrating the operational Froude number and speed for various conventional ship types.

In FIG. 1, the relationship between a ship's waterline length, speed and the Froude number at which it is operating is shown. Gravity waves resulting from a ship with forward speed are the source of a ships wave resistance. The Froude number is an indication of the gravitational wave pattern and resulting wave resistance that is created by the ship. Displacement ships using prior knowledge operate at Froude numbers below 0.4 (FIG. 20). According to the prior art and knowledge, operation of displacement ships at a higher Froude number results in poor fuel efficiency and requires high propulsive power.

Because of this Froude number limitation, ship designs for high speed operations have been required to be long for efficient operation. For example, a displacement ship designed for operation at 30 knots must be 500 feet in length (or longer) for fuel-efficient operation.

It is known that maximum wave resistance occurs near the Froude number=0.5 curve, which is often referred to as the hump speed. Above a Froude number of 0.5, the wave resistance decreases, reaching a low level in the 0.8 to 1.0 Froude number range and continuing to decrease with increased Froude number.

Figure 21:
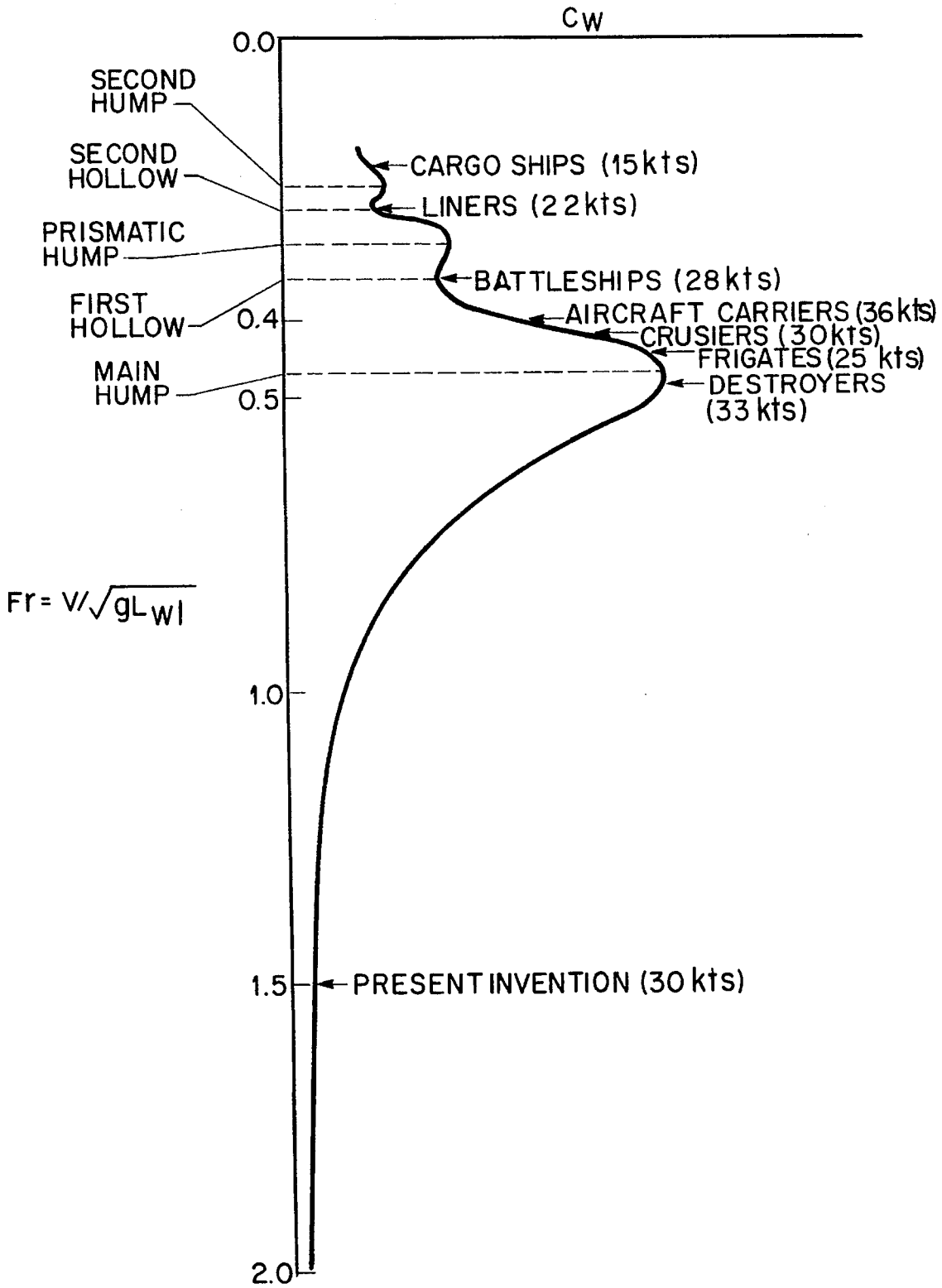
FIG. 21 is a graph illustrating the operational Froude number and speed for a ship of the present invention as compared to various conventional ship types.

Vessels according to the present invention are capable of operating efficiently at a Froude number of 0.8 or higher. This is shown on FIG. 21 with conventional displacement ship operational Froude numbers also being referenced.

FIG. 2 illustrates a theoretical wave resistance comparison for two 500 long ton vessels; one of conventional SWATH construction and one constructed according to the present invention.

The SWATH vessel of the prior art has a hull form (FIG. 4) with supporting struts of 111 feet in length and submerged hulls of 130 feet in length. As seen in FIG. 2 rapid increase in wave resistance occurs for the prior art vessel at 15 knots or a Froude number of 0.39 based on the submerged hull length of 130 feet. The wave resistance nears a maximum at 20 knots (Froude number=0.52) and decreases only slightly at speeds up through 35 knots (Froude number=0.9).

Figure 5:
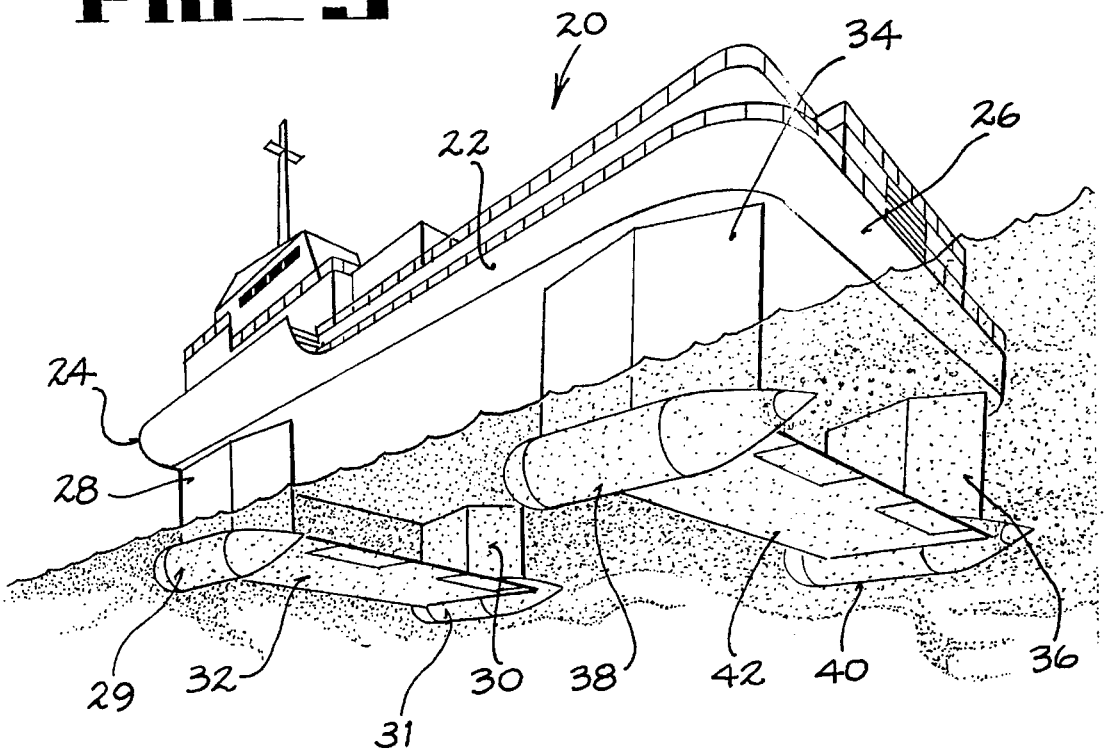
FIG. 5 is an isometric view of a ship incorporating a first embodiment of the present invention.

The small waterplane hull form of the present invention, shown in FIG. 5, has struts and transverse foils of 28 feet in length. A rapid increase in wave resistance occurs for this hull form at 7 knots (Froude number=0.39) reaching a maximum at 13 knots (Froude number=0.73) and decreasing to a low level at 17 knots (Froude number=0.95). Although the wave resistance is large at lower speeds for the hull form of the present invention it is substantially lower (8 versus 35 thousand lbs.) at the design speed of 20 knots.

The graph of FIG. 3 presents predictions of the total effective horsepower (EHP) required for each design. Power reduction at high speed varies from almost 40 percent at 19 knots to 18 percent at 30 knots. In other words, at a given power an approximate 3 knot gain in speed is realized.

Two factors key to the design of vessels of the present invention are the streamwise length and spacing of the hull components. Vessels of the present invention are configured such that all submerged hull elements (struts, foils and pods) are short in streamwise length. The limit in length is defined by the design operational speed and the F=0.8 curve. For example, by using the formula for Froude number it can be determined that the maximum length of any submerged hull element is 55 ft. for a vessel designed to operate efficiently at speeds above 20 knots.

Figure 8:
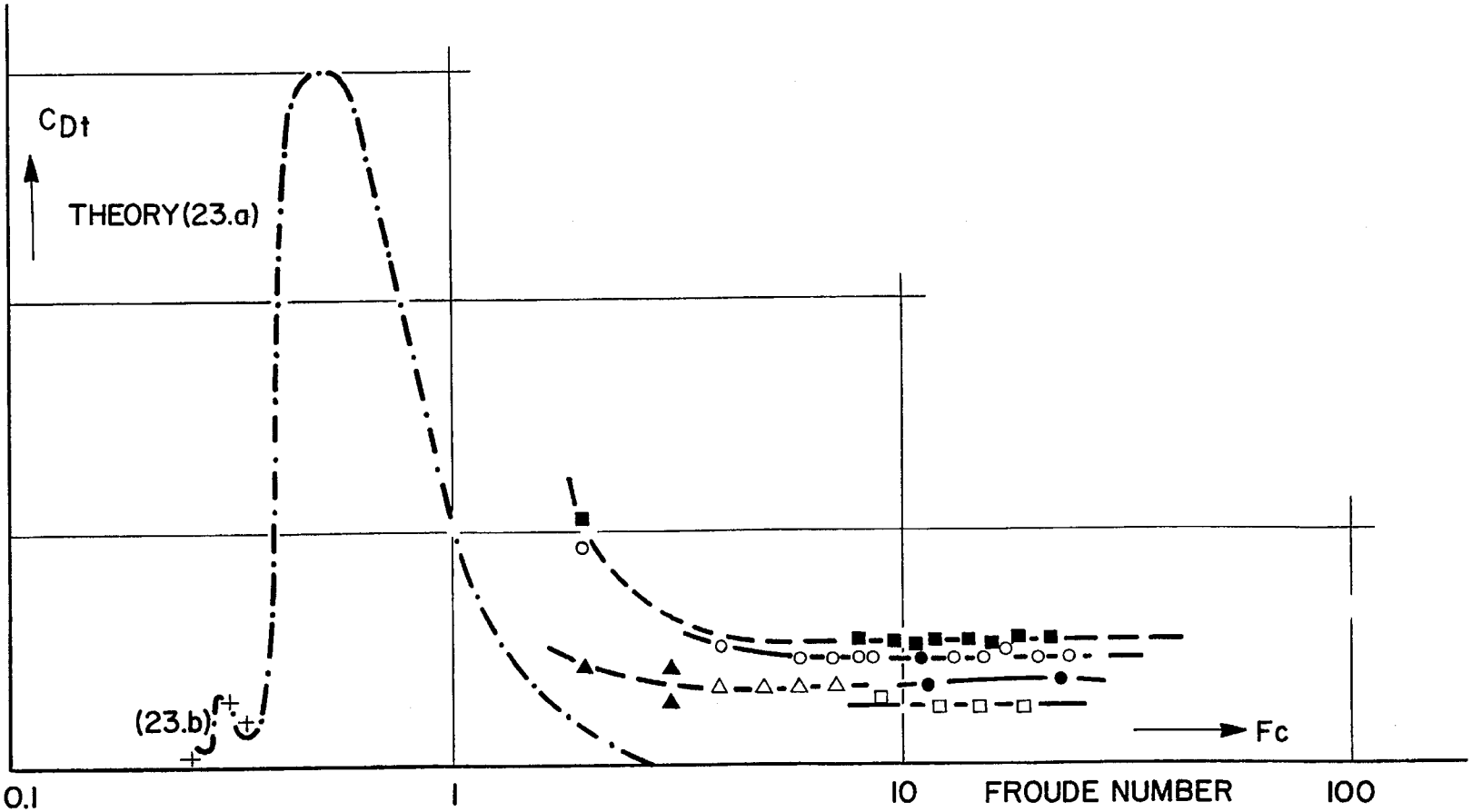
FIG. 8 is a graph illustrating the theoretical wave resistance coefficient for a surface piercing strut.

FIG. 8 illustrates the theoretical wave resistance for a surface piercing strut. The rapid increase in wave resistance for a strut occurs at F=0.4, approaching a maximum near F=0.5 and decreases to a low level at higher Froude numbers (above F=1.0). A detailed explanation of this phenomenon is set forth in the publication by Hoerner, previously cited. This characteristic is representative of the wave resistance contribution of the struts for low waterplane area ships of both the prior art and the present invention.

The teaching of the present invention is to have a speed to strut chord length relationship that has a Froude number greater than or equal to 1.0 at the design operational speed.

Figure 9:
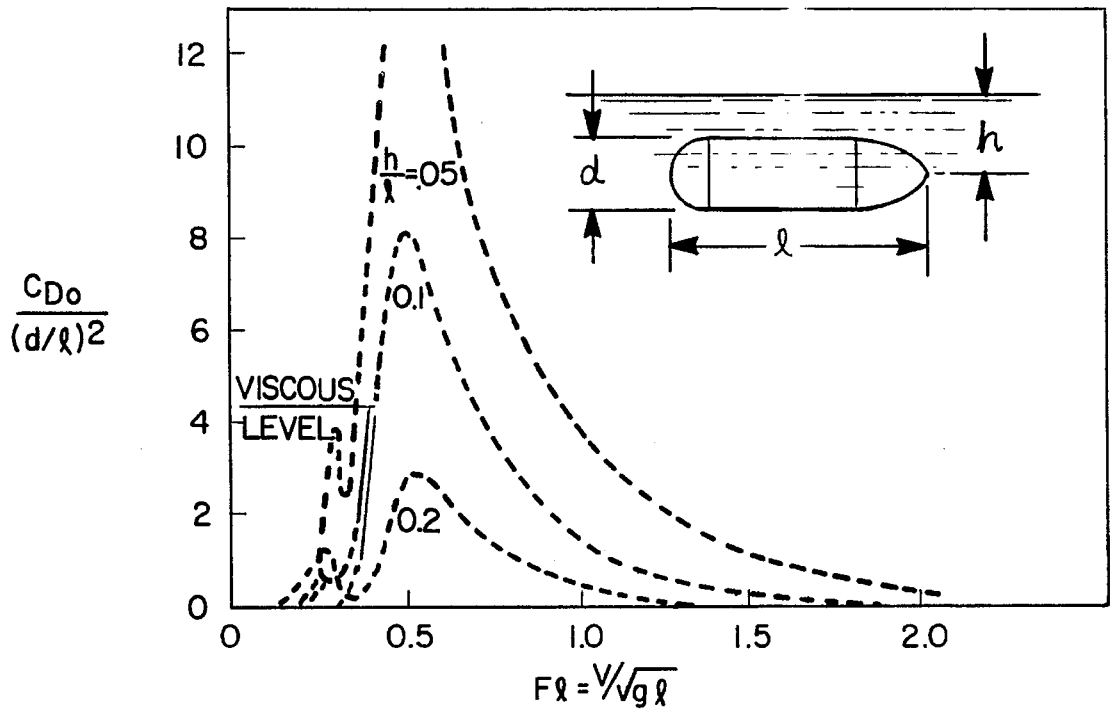
FIG. 9 is a graph illustrating the theoretical wave resistance coefficient for a submerged lower hull for various diameter to length ratios at several submergence to length ratios.

Theoretical wave resistance is shown for submerged lower hulls in FIG. 9. Wave resistance coefficient, normalized by the diameter to length ratio squared, is plotted against the Froude number for various ratios of submergence depth to hull length. As with the surface piercing strut, wave resistance increases rapidly at F=0.4 peaking at F=0.5 and decreasing to a low value of approximately 1.0.

The resistance coefficient, normalized by diameter to length ratio squared, varies with the immersion to length ratio. As determined from the curve of FIG. 9, a prior art SWATH vessel (FIG. 4) operating at 20 knots, at a Froude number of 0.52, would have a hull wave coefficient, $CD_o$, of approximately 0.09 while the resistance coefficient for the short length streamlined pod of the present invention (FIG. 5) operating at a 20 knot speed (Froude number=1) would have a wave resistance coefficient of less than 0.03. Wave resistance coefficient is defined as follows:

$$CD = \frac{\text{Wave resistance}}{1/2\ \rho\ V^2 A}$$

where p=density of water

V=speed

A=frontal area

For hull submergence ratios that are practical for semi-submerged ships the wave resistance becomes excessive for Froude numbers between 0.4 and 0.8. These ships, by nature of their elongated lower hulls, are limited in speed to Froude numbers below 0.4 for fuel efficient operation. All previous embodiments of semi-submerged ships use an arrangement of elongated (small cross-section area as compared to length) submerged hulls to provide the majority of the buoyancy.

Figure 10:
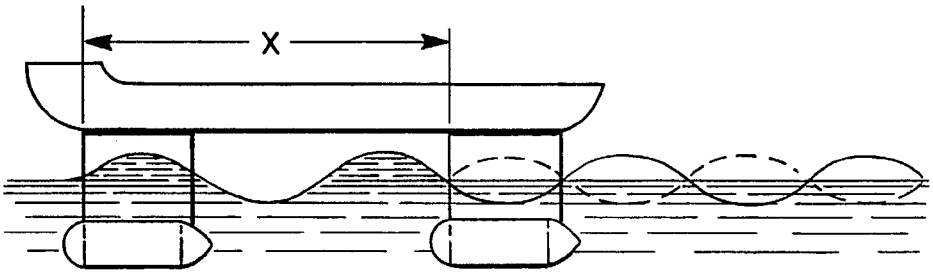
FIG. 10 is a schematic side view showing the relationship of strut and hull spacing according to the invention to minimize hump wave resistance.

Spacing of the hull components can best be understood from FIG. 10. The transverse wave system pattern shown in FIG. 10 is the primary contributor to wave resistance. Cancellation of this transverse wave can be accomplished by spacing forward and aft hull elements at a distance in which the transverse waves created by each element are 180 degrees out of phase. The relationship between transverse wave length and speed is defined as follows:

$$\lambda = \frac{2\pi V^2}{g}$$

where

λ=wave length

V=speed g=acceleration due to gravity.

FIG. 10 shows a possible strut spacing to minimize the wave resistance hump. Cancellation of the transverse wave would occur at strut spacings (X) of 0.5λ, 1.5λ, 2.5λ . . . wave lengths. At hump speed, where the wave length is twice the component length, the spacing would be 3, 5, 7 . . . strut lengths.

Figure 22:
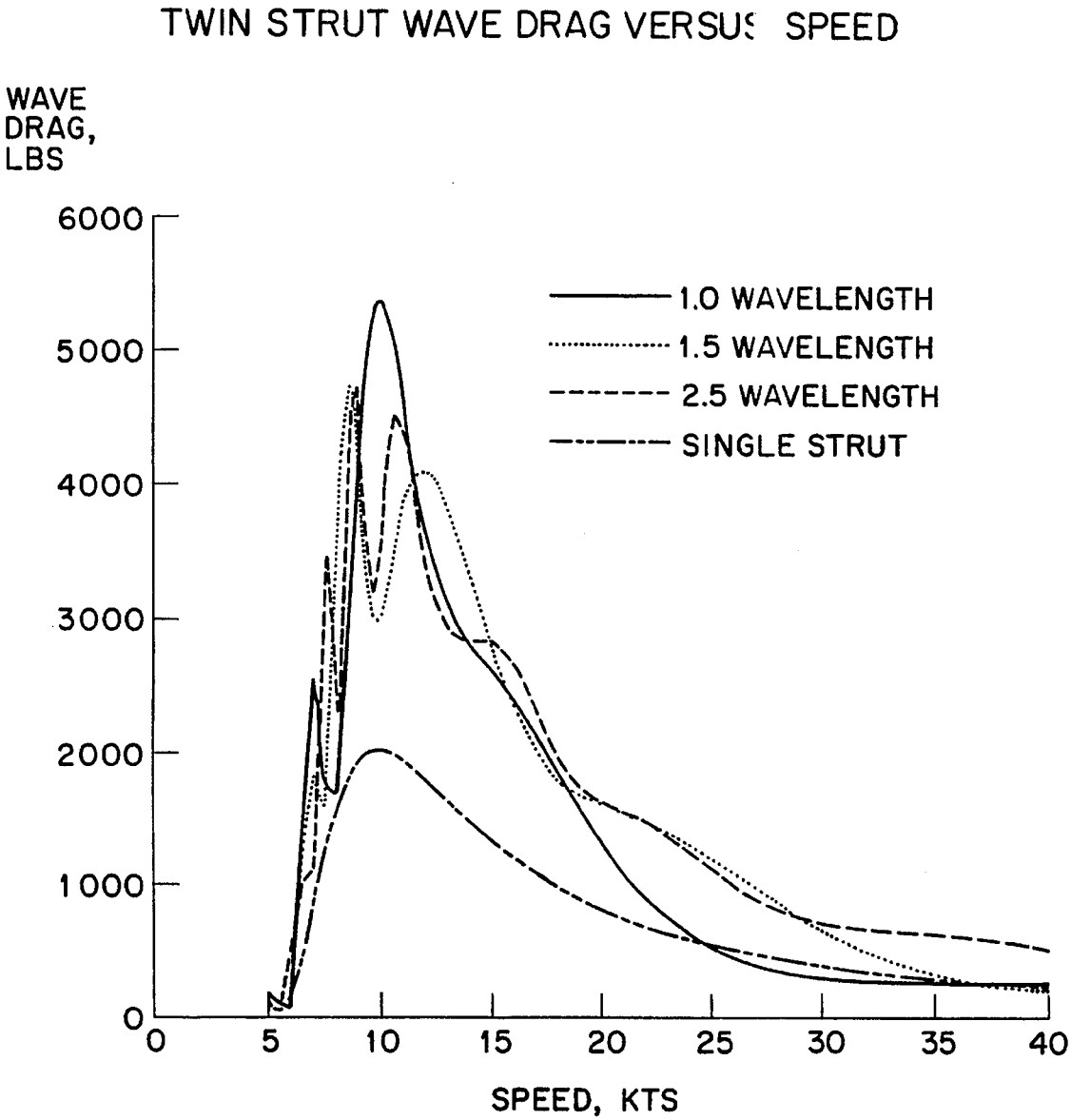
FIG. 22 is a graph illustrating the wave resistance for a single strut and the effect of strut spacing for a two strut tandem arrangement.

FIG. 22 is an example showing the effects of spacing on wave drag for two 24 foot chord (streamwise length) struts at various spacings. For a single strut (also shown) the hump occurs at 9.5 knots. The predictions show a wave drag cancellation at the 9.5 knot hump speed for 1.5 and 2.5 wave length spacings when compared to an increase in wave resistance at a 1.0 wave length spacing.

Figure 23:
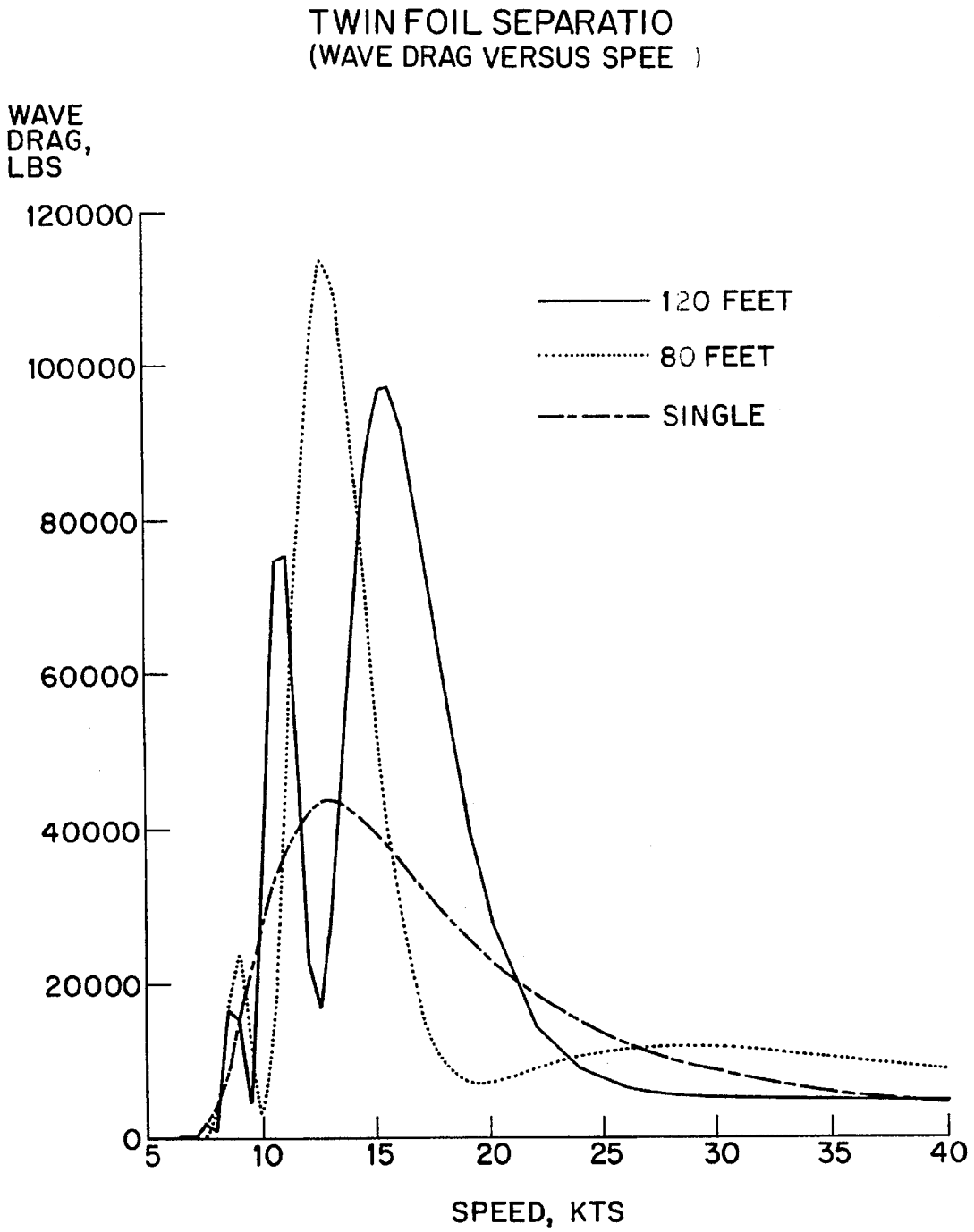
FIG. 23 is a graph illustrating the wave resistance for a single transverse foil and the-effect of spacing for a two foil arrangement.

In addition to the struts, vessels of the present invention are comprised of other major buoyancy elements i.e. the transverse foils and/or pods. The spacing for these hull elements is in accordance with the teachings for the spacing of the strut elements. That is, hull elements (struts, pods or transverse foils) are to be spaced at an odd number (1, 3, 5 . . . ) of element lengths. FIG. 23 is an example that shows the effect of spacing on wave resistance for two submerged foils.

When the various elements are required to be of differing lengths due to displacement or arrangement requirements the preferred design would still provide for the critical wave cancellation at the hump speeds. (Each element would have a hump speed corresponding to its length and is to be spaced accordingly.) For example a vessel with 24 foot struts spaced at 5 lengths (120 feet) could be arranged optimally with 40 foot transverse foils at 3 length spacing (120 feet).

It is recognized that all vessel hull designs must be consistent with naval architecture hydrostatic stability requirements. In general strut dimensions (thickness, chord and waterplane area) and placement (beam and length separations) along with vessel weight, center of gravity and center of buoyancy establishes the vehicle's stability. Embodiments are shown in FIGS. 17 through 20 that can provide for increased stability.

Figure 4:
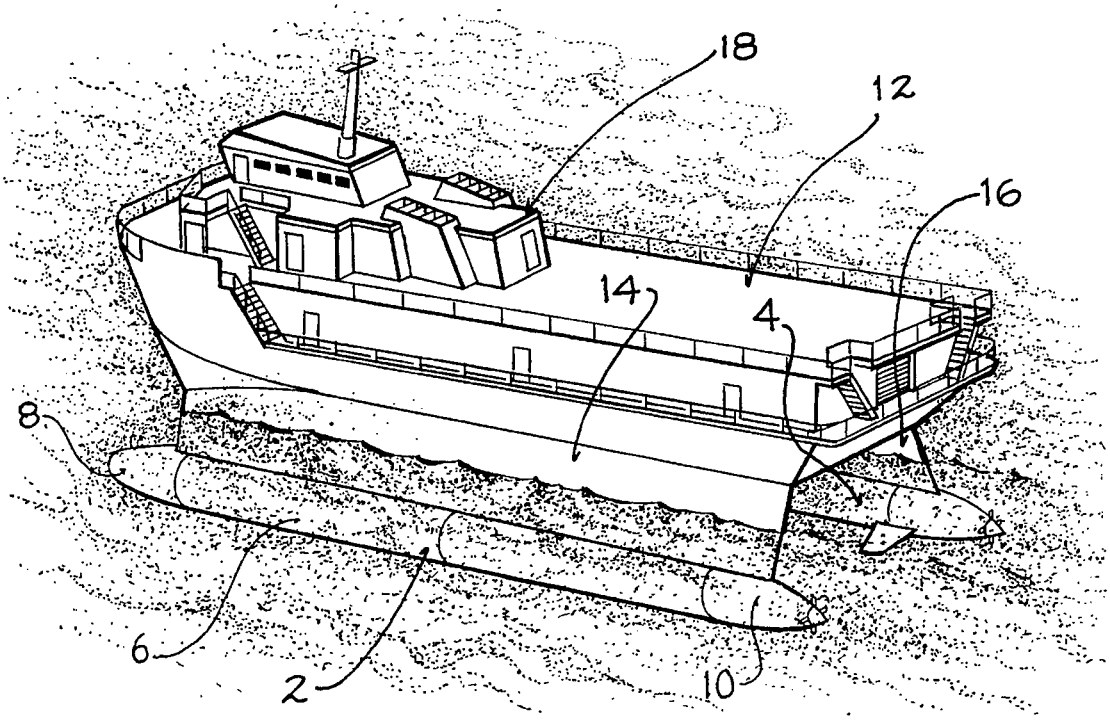
FIG 4 PRIOR ART
FIG. 4 is an isometric view of a prior art SWATH ship; its principle characteristics are that it has a 500 long ton displacement, 111 ft. strut length and 130 ft. submerged lower hull.

The prior art approach is shown in FIG. 4. In this prior art, buoyancy support is provided by a pair of essentially tubular-shaped parallel submerged hulls 2 and 4. Each of the submerged hulls is made in the form of a long cylindrical shape 6 that includes a rounded bow 8 and a tapered stern 10.

The submerged hulls 2 and 4 provide buoyant support for the upper hull 12 through a pair of supporting struts 14 and 16. The supporting struts are long and narrow and are designed to provide a minimum of resistance. In other words, the struts have a low thickness to cord ratio.

The upper hull 12 is shown as a platform and it includes a raised superstructure 18. Ship machinery, crew quarters and the like are located within the platform.

The principal characteristics of the ship shown in FIG. 4 are that it has a displacement of 500 long tons, a strut length of 111 feet, and a submerged lower hull length of 130 feet. When compared to the curve of ship speed versus waterline length (FIG. 1), it is noted that at Froude number 0.5 the vessel's maximum speed is 20 knots. However, this is not a fuel or power efficient speed of operation for the type of ship. Higher fuel efficiency is achieved at Froude number 0.4 which provides for a top speed of 14 knots. This result is also shown in the FIG. 3 chart.

FIG. 5 shows a small waterplane area ship 20 according to the present invention having an above water plane load carrying hull structure 22, with a bow portion 24 and a stern portion 26. Depending from bow portion 24 are a set of dual struts 28, 30. Depending from the bow struts are a dual set of pods 29, 31. Connected between the pods 29, 31 is a streamlined displacement foil 32. A second set of struts 34, 36, arranged in tandem with struts 28, 30, depend from the stern portion 26 of the hull structure. These struts are subtended by propulsion pods 38, 40 which carry conventional means for propelling the ship. A second streamlined displacement foil 42 extends laterally between the propulsion pods.

The foils 32, 42 and pods 29, 31, 38 and 40 provide the major buoyancy for the ship. Due to their short stream wise length, they reduce wave resistance at moderate to high speeds as defined by Froude numbers greater than 0.8.

Figure 6:
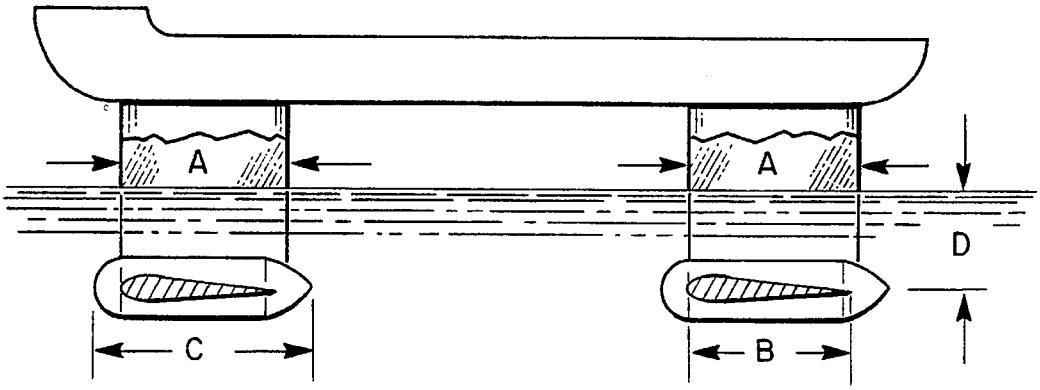
FIG. 6 is a sectional inboard view of the ship of FIG. 5.

FIG. 6 shows the dimensions critical to the design of a vessel of the present invention. Strut and foil chord lengths (A and B respectively), pod length (C) and immersion (D) are all factors in the wave making resistance. The impact of these dimensions on wave resistance is shown in FIGS. 8 and 9.

Figure 7:
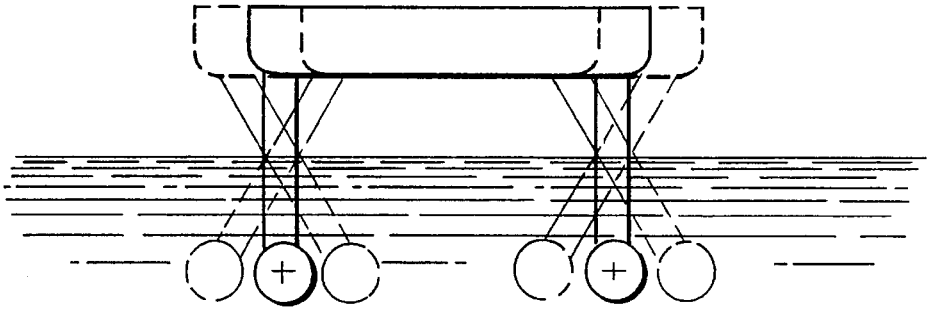
FIG. 7 is a schematic front view of the ship of FIG. 5 and also shows alternate strut arrangements in phantom.

FIG. 7 shows a front view of the ship of FIG. 5 with alternate strut arrangements in phantom. The advantage offered by these strut arrangements is the ability to optimize the beam of the upper hull cross structure with the span of the transverse streamlined foils.

Figure 11:
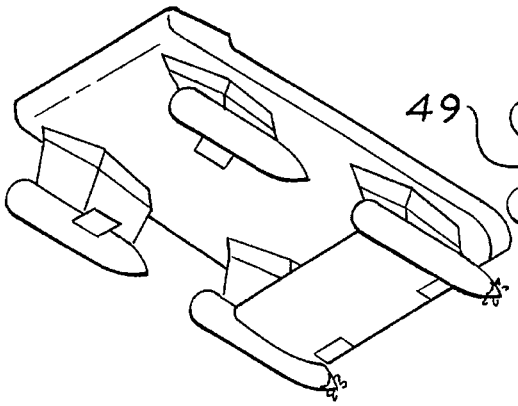
FIGS. 11 through 19 are perspective views illustrating alternative embodiments of the present invention.

FIG. 11 shows a ship differing from the configuration shown in FIG. 5 by removing the forward streamlined transverse foil and replacing it with control fins subtending the forward buoyancy pods. The struts shown are inclined outwardly from the center of the hull structure. The struts may also be inclined inwardly. Such embodiments have the advantage of increased dynamic pitch stability.

Figure 12:
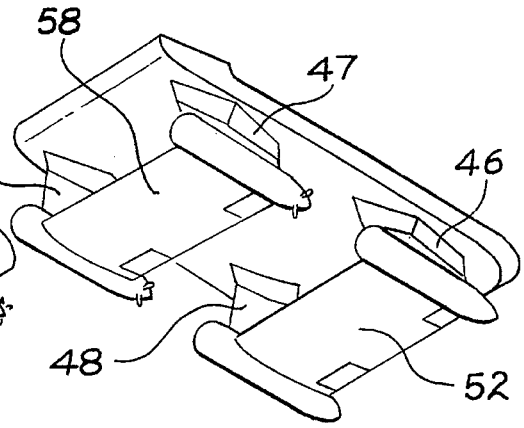

FIG. 12 shows a ship with essentially the same configuration as that shown in FIG. 5 except that the struts 46, 47, 48 and 49 are inclined at an angle outwardly from the center of the hull structure. This embodiment has the advantage of increased span for the transverse foils increasing displacement for the buoyant foils 52 and 58 with no increase in upper hull beam. It is also recognized that the struts 46, 47, 48 and 49 could be inclined at an angle inward from the center structure allowing for a decreased span for the transverse foil with no decrease in upper hull beam.

Figure 13:
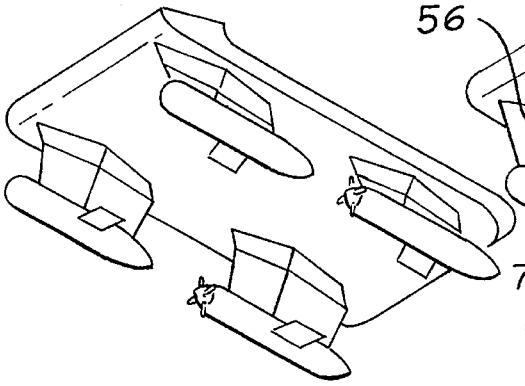

In the embodiment shown in FIG. 13, no transverse foils are included. Instead of the transverse foils, individual foils are subtended from each of the struts. The propulsion pods are mounted in the rear struts and they are designed with the driving propellers on the forward portion of the propulsion pods. Propulsion pods are shown depending from the forward struts reducing propeller vulnerability for some applications.

Figure 14:
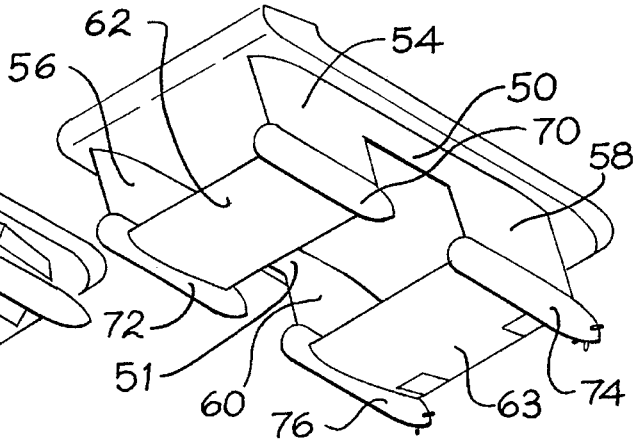

The embodiment shown in FIG. 14 has dual struts 50, 51 extending almost the length of the ship. These struts have extensions 54, 56 on their front portions and vertical extensions 58, 60 on their rear portions terminating in forward buoyancy pods 70, 72 and aft propulsion pods 74 and 76. Streamlined foil 62 and 63 extend laterally between the pods.

Figure 15:
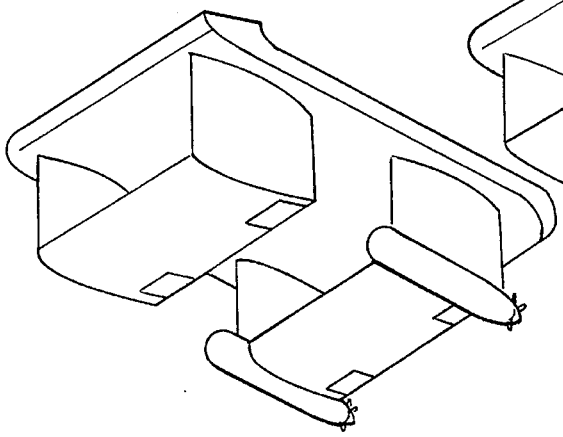

FIG. 15 shows an alternative embodiment of the present invention. In this embodiment, a transverse foil is subtended directly from each of the forward struts. This embodiment has no forward pods but includes aft propulsion pods.

Figure 16:
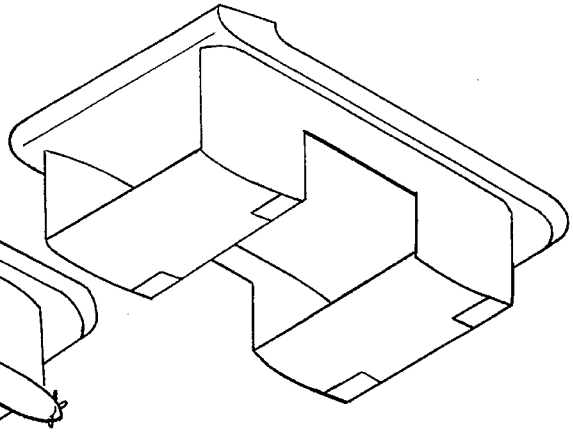

Another alternative embodiment is shown in FIG. 16. In this embodiment, the transverse foils are subtended from the forward and aft struts. All buoyancy elements are foil shaped with no pods included.

Figure 17:
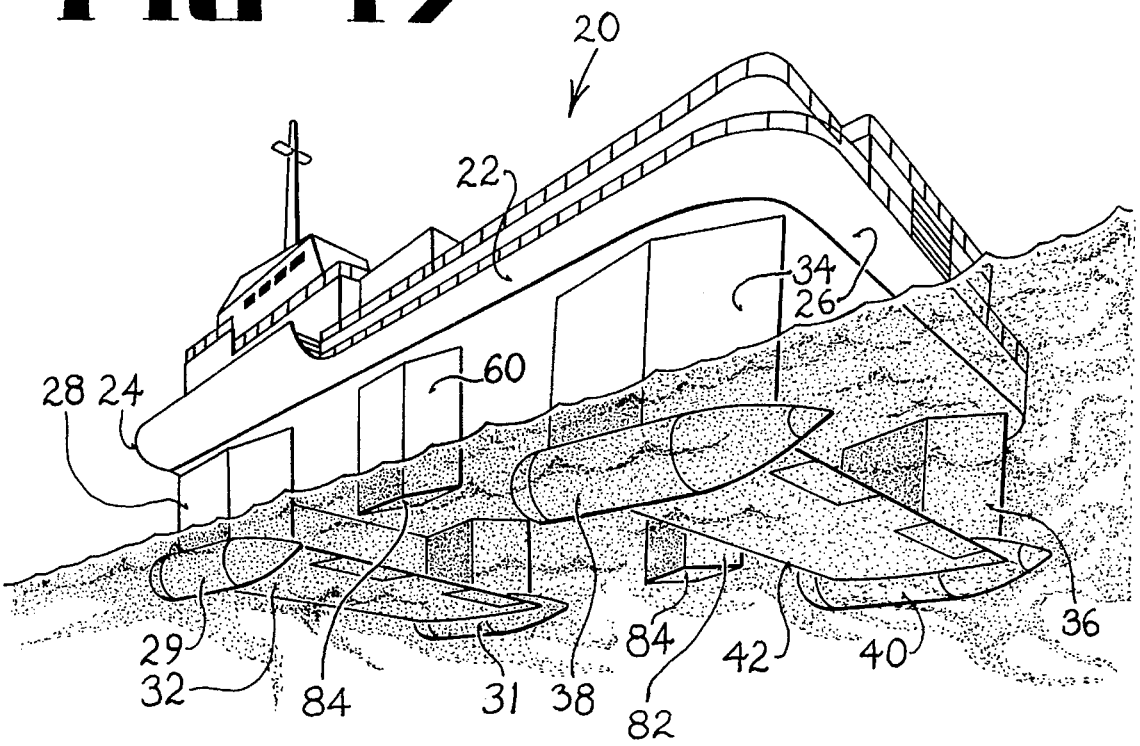

FIG. 17 illustrates another embodiment of the invention similar to FIG. 5. In this embodiment a third pair of struts 60, 82 are provided on opposite sides of ship 20 between the fore and aft pairs of struts. This third pair of struts is located from the front pair of struts by a distance equal to ½ the length of the transverse wave formed by the front struts at hump speed to create destructive wave interference. These struts have bottom ends 84 which are located slightly below the design water line to provide wave piercing and wave interference.

Figure 18:
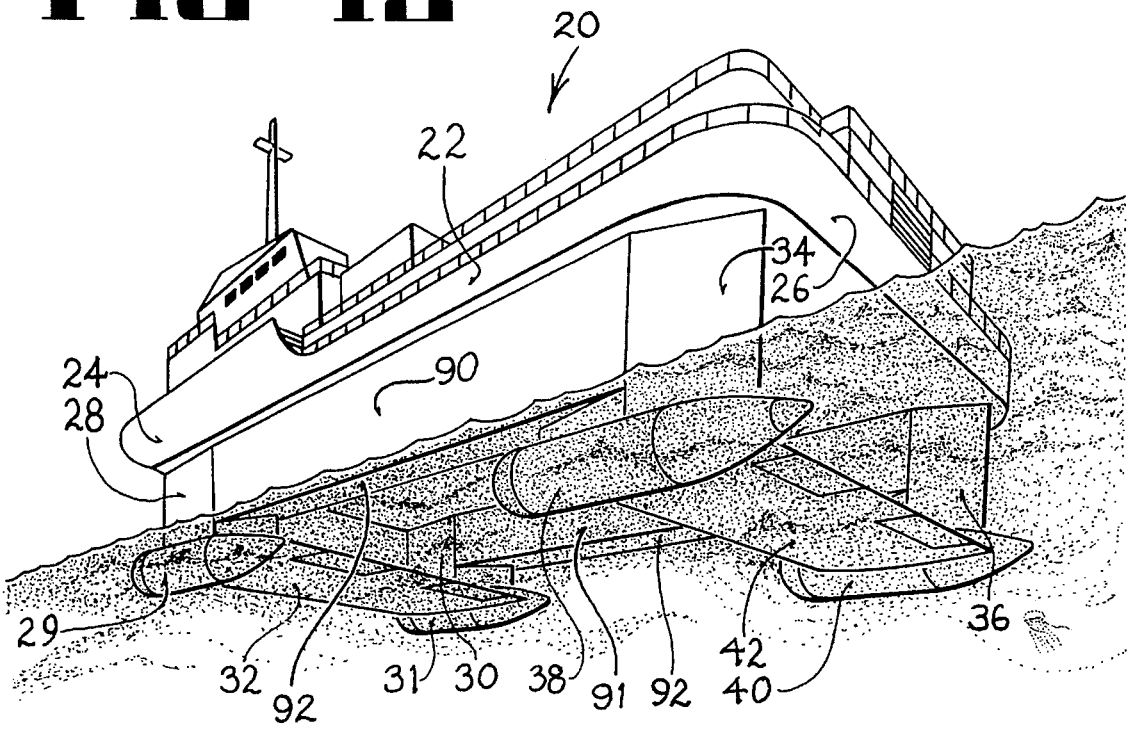

FIG. 18 illustrates yet another embodiment of the invention which is similar to the embodiment of FIG. 14. In this case the ship 20 includes dual struts 90, 91 extending the length of the ship, but having a bottom 92 which is located slightly below the design water line to provide a wave piercing action. These elongated struts will also provide some additional buoyancy when the vessel lists.

Figure 19:
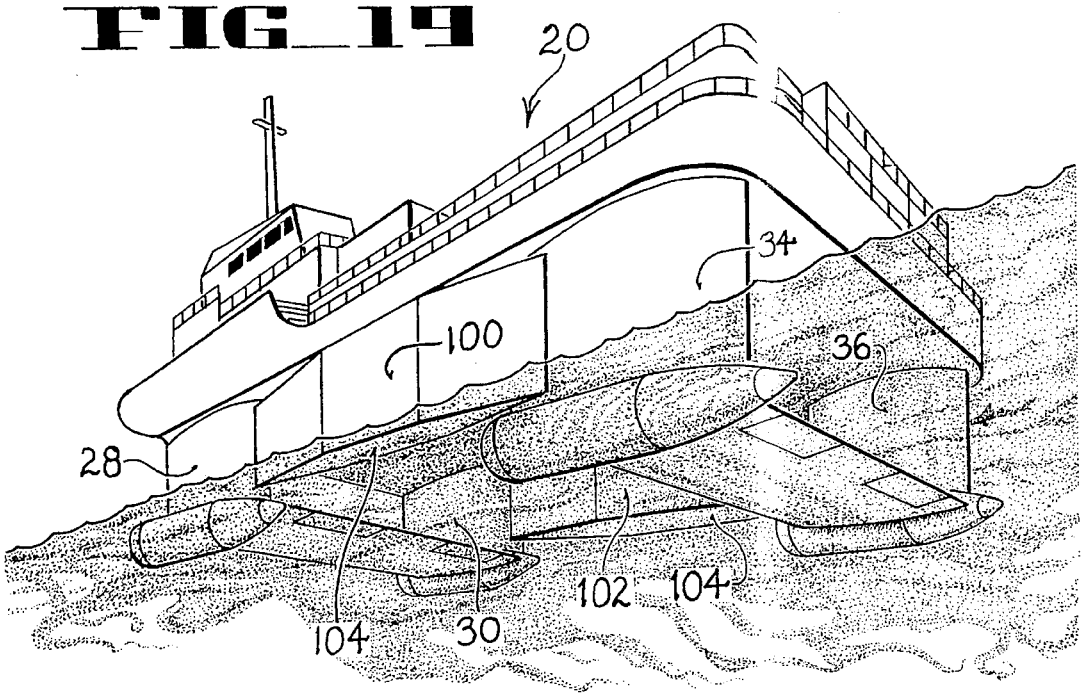

FIG. 19 illustrates an embodiment of the invention which is similar to FIG. 15, but in this case intermediate struts 100, 102 are provided outboard of the fore and aft struts. These intermediate struts, in this embodiment, have a length sufficient to overlap the trailing edge of the forward struts and the forward edges of the aft struts. They also have bottom edges 104 located to be slightly below the design water line of the vessel to provide destructive wave interference and additional buoyancy in a listing condition.

In another embodiment of the invention which is similar to that of FIG. 5, a third intermediate strut is provided between the struts 28, 30 and 34, 36 of the fore and aft pair of struts.

Figure 24:
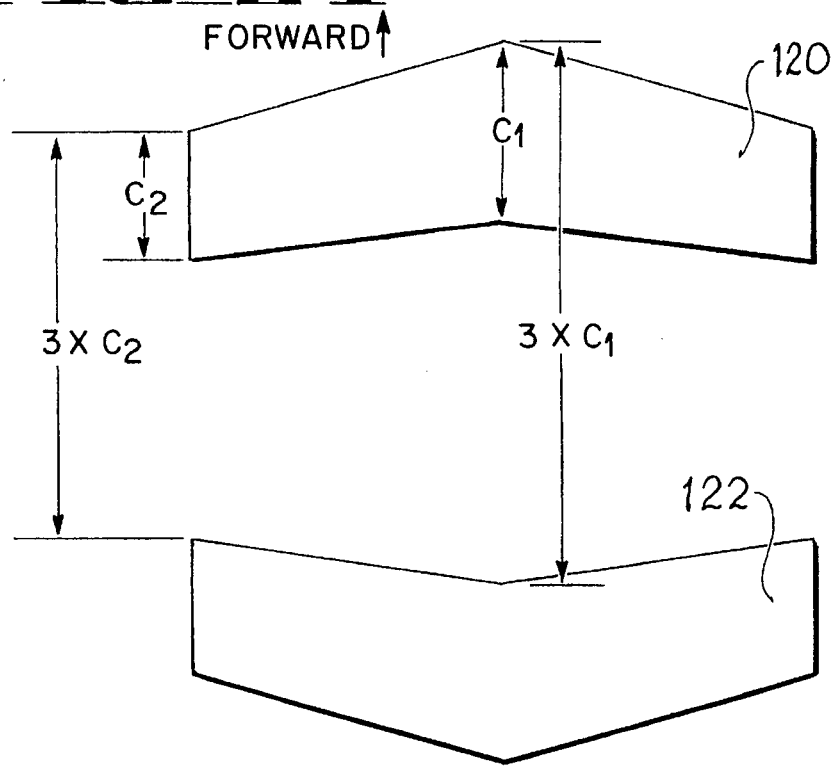
FIGS. 24–27 are schematic plan views of various transverse foil structures which can be used in vessels constructed according to the present invention.

Although the transverse foils 32, 42 of the various above described embodiments have been illustrated as having straight transverse forward and trailing edges, it is contemplated that these foils may be formed with varying chord dimensions as shown in FIGS. 24–27. In the embodiment of FIG. 24 the forward foil 120 has its largest chord dimension $C_1$ selected in accordance with the prior description to permit operation of the vessel at Froude number of 0.8 and higher. The chord dimension of the foil decreases outwardly towards its ends to a minimum chord length $C_2$. The aft foil 122 has the same dimensions as foil 120 but is positioned in the opposite orientation. The foils are spaced so that the distance between the forward center point on each foil is $3\times C_1$ and the distance between the forward outboard edges of each foil is $3\times C_2$, in order to produce wave interference.

Figure 25:
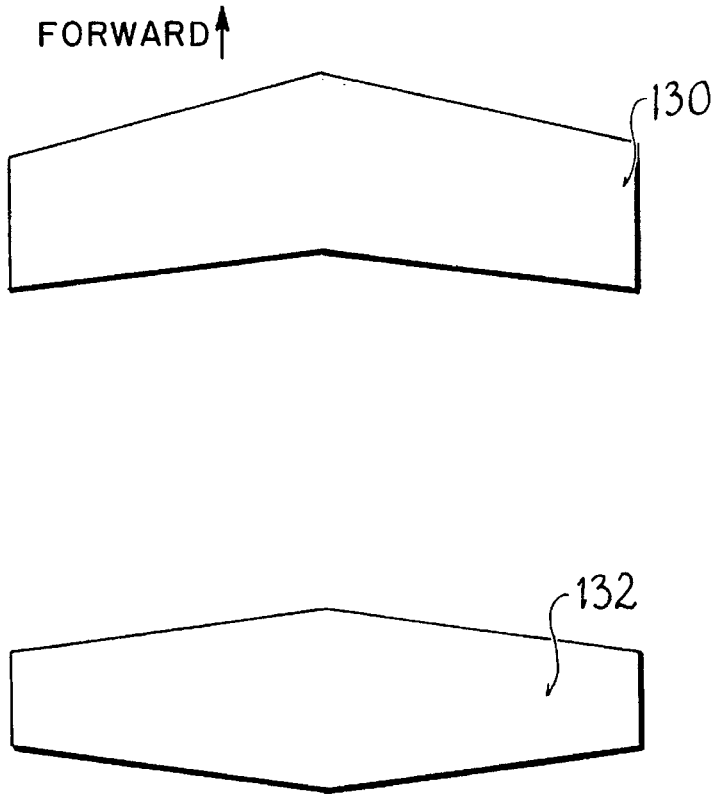
Figure 26:
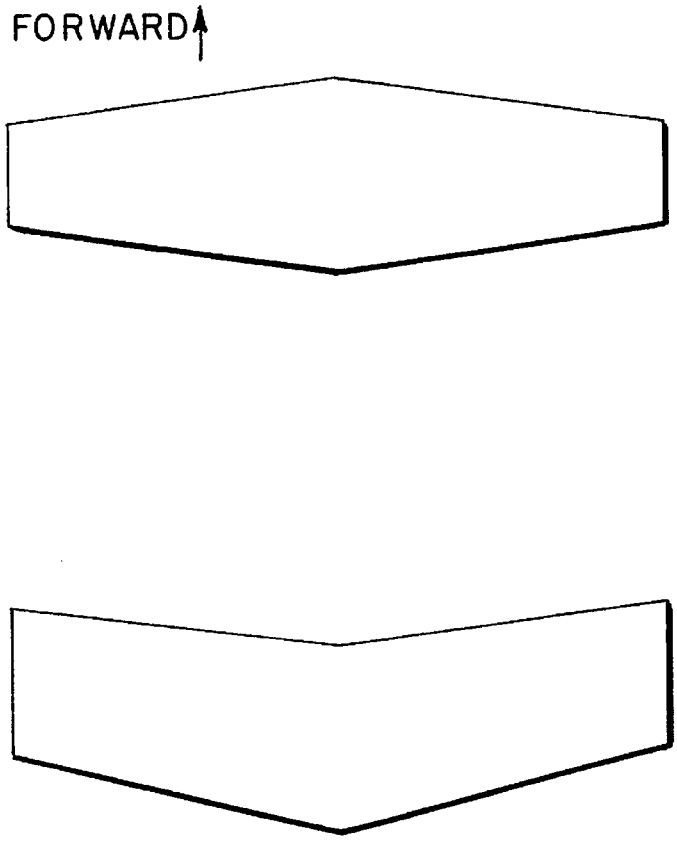

Instead of using the "swept wing" foil configurations for both foils as in the embodiment of FIG. 24 only one of the foils can have the swept wing configuration and the other can be formed in the same dimension but with no sweep. As shown in FIG. 25 the forward foil 130 has the swept back configuration while the aft foil 132 is "diamond" shaped. The foil dimension and spacing can be as described above with respect to FIGS. 24. FIG. 26 illustrates an embodiment in which the foils are reversed from the positions shown in FIG. 25.

Figure 27:
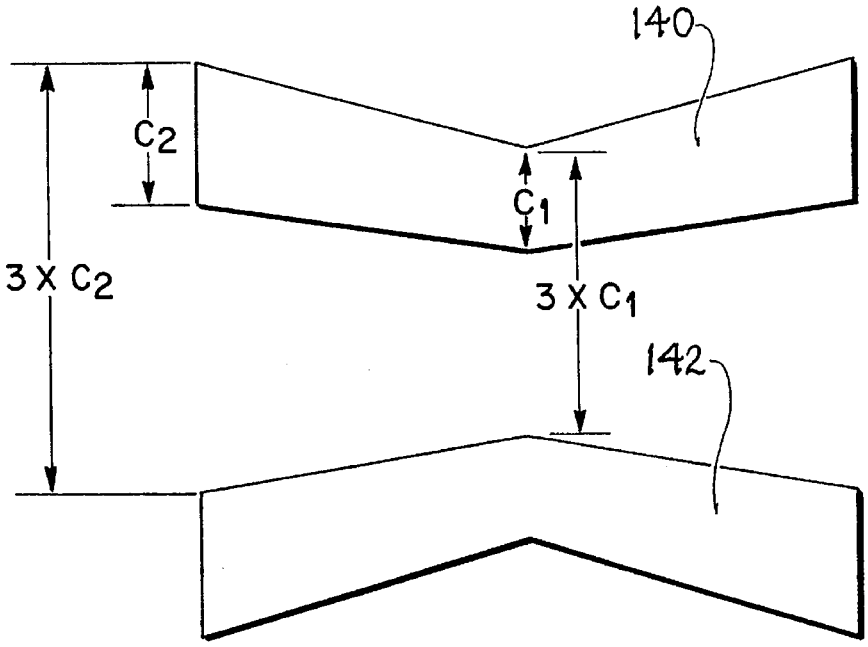

Yet another foil configuration is illustrated in FIG. 27 wherein the center chord dimension is the smallest and the outboard chord dimension is the largest. In addition the forward edge 144 of the aft foil 142 is straight. This configuration will produce a hump wave at different speeds for different chord lengths.

Although several illustrative embodiments of the inventions have been described herein, it is to be understood that various changes and modifications may be effected therein by those skilled in the art without departing from the scope or spirit of the invention.

What is claimed is:

1. A small waterplane area high speed ship comprising a hull structure having a bow portion and a stem portion and being normally supported above the surface of the water when in operation, a forward set of dual struts depending from the bow portion of the hull structure, said dual struts subtended by a first transverse displacement foil extending laterally between and connected to each of said dual struts, said first transverse displacement foil being attached to said forward set of dual struts at a fixed, non-rotatable longitudinal inclination, a second set of aft dual struts depending from the stern portion of the hull structure, said second set of dual struts being subtended by a second transverse displacement foil extending laterally between and connected to each of said struts, said second transverse displacement foil being attached to said second set of aft dual struts at a fixed, non-rotatable longitudinal inclination; said transverse displacement foils providing the major buoyancy for the ship during operation to maintain said hull above the surface of the water during operation, said forward and aft struts and said foils being spaced longitudinally a predetermined distance selected such that the transverse waves created by the forward struts and transverse displacement foil and the aft struts and transverse displacement foil are 180° out of phase at the critical hump speed, the hull speed region at which a large increase in wave resistance occurs as a main or primary hump on a wave drag curve so as to result in a requirement for a maximum increase in propulsion power.

2. A small waterplane area high speed ship as defined in claim 1 including a pair of propulsion pods respectively mounted on the struts of said second set of dual struts.

3. A small waterplane area high speed ship as defined in claim 1 wherein said predetermined distance is equal to an odd multiple of the waterline length of the struts and foils.

4. A small waterplane area high speed ship as defined in claim 3 wherein the length of the struts and foils is selected such that at the design operational speed of the vessel its Froude number is 0.8 or higher.

5. A small waterplane area high speed ship comprising a hull structure having a bow portion and a stern portion and being normally supported above the surface of the water when in operation; bow and stern pairs of longitudinal struts depending from the hull structure, a first transverse displacement foil extending between and connected to the pair of bow struts, at a fixed, non-rotatable longitudinal inclination a pair of propulsion pods subtending the stern struts, and a second transverse displacement foil extending between and connected to said pods at a fixed, non-rotatable inclination; said transverse displacement foils and said pods providing the major buoyancy for the ship during operation to maintain said hull above the surface of the water in a level altitude; said bow and stern struts being spaced longitudinally a predetermined distance selected such that the transverse wave created by the corresponding bow and stern struts are 180° out of phase at the hump speed, the hull speed region at which a large increase in wave resistance occurs as a main or primary hump on a wave drag curve so as to result in a requirement for a maximum increase in propulsion power.

6. A small waterplane area high speed ship as defined in claim 5 wherein said predetermined distance is equal to an odd multiple of the water length of the struts.

7. A small waterplane area high speed ship as defined in claim 6 wherein the length of the struts and foils is selected such that at the design operational speed of the vessel its Froude number is 0.8 or higher.

8. A small waterplane area high speed ship as defined in claim 5 wherein said struts depend angularly away from the hulls.

9. A small waterplane area ship according to claim 5 including control surface means on the second transverse displacement foil for controlling maneuvering trim, list, ship motions and stability when underway.

10. A small waterplane area high speed ship comprising a hull structure having a bow portion and a stern portion and being normally supported above the surface of the water when in operation; bow and stern pairs of longitudinal struts depending from the hull structure, a first transverse displacement foil extending between and connected to the pair of bow struts a pair of propulsion pods subtending the stern struts, and a second transverse displacement foil extending between and connected to said pods; said transverse displacement foils and said pods providing the major buoyancy for the ship during operation to maintain said hull above the surface of the water in a level altitude; said bow and stem struts being spaced longitudinally a predetermined distance selected such that the transverse wave created by the corresponding bow and stern struts are 180° out of phase at the hump speed, the hull speed region at which a large increase in wave resistance occurs as a main or primary hump on a wave drag curve so as to result in a requirement for a maximum increase in propulsion power, and including means located between said bow and stem struts for creating destructive wave interference.

11. A small waterplane area high speed ship as defined in claim 8 wherein said means comprises a third pair of struts.

12. A small waterplane area high speed ship as defined in claim 9 wherein said third pair of struts have free bottom ends located below the design waterline of the ship and above the bottoms of said bow and stern struts.

13. A small waterplane area high speed ship comprising a hull structure having a bow portion and a stem portion and being normally supported above the surface of time water when in operation; bow and stem pairs of longitudinal struts depending from the hull structure, a first transverse displacement foil extending between and connected to the pair of bow struts, a pair of propulsion pods subtending the stern struts, and a second transverse displacement foil extending between and connected to said pods; said transverse displacement foils and said pods providing the major buoyancy for the ship during operation to maintain said hull above the surface of the water in a level altitude; said bow and stern struts being spaced longitudinally a predetermined distance selected such that the transverse wave created by the corresponding bow and stern struts are 180° out of phase at the hump speed, the hull speed region at which a large increase in wave resistance occurs as a main or primary hump on a wave drag curve so as to result in a requirement for a maximum increase in propulsion power; and including a pair of elongated buoyancy means respectively located on opposite sides of the ship and extending between said struts, said buoyancy means having a lower edge located slightly below the design waterline of the ship.

14. A small waterplane area high speed ship comprising a hull structure having a bow portion and stern portion, and being normally supported above the surface of the water when in operation, a first set of dual bow struts depending from the bow portion of the hull structure, a second set of dual stern struts depending from the stern portion of the hull structure, a first buoyancy means subtended from said set of dual bow struts and connected to the struts at a fixed, non-rotatable longitudinal inclination, and second buoyancy means subtended from said set of dual stern struts and connected to the struts at a fixed, non-rotatable longitudinal inclination, said bow and stern sets of struts each having a length dimension from bow to stern determined by the formula $$F=\frac{v}{\sqrt{gl}}$$

where

F=design Froude number

V=design speed of the small waterplane area high speed ship in feet per second l=longitudinal length of the struts in feet g=acceleration due to gravity in feet per second squared and the design Froude number is 0.8 or greater, said buoyancy means providing the major buoyancy for the ship during operation to maintain said hull above the surface of the water in a generally level attitude and wherein said bow and stern sets of struts and said first and second buoyancy means are spaced apart by longitudinal distances which provide transverse wave drag cancellation at hump speed the hull speed region at which a large increase in wave resistance occurs as a main or primary hump on a wave drag curve so as to result in a requirement for a maximum increase in propulsion power.

15. A small waterplane area high speed ship comprising a hull structure having a bow portion and stern portion, and being normally supported above the surface of the water when in operation, a first set of dual bow struts depending from the bow portion or the hull structure, a second set of dual stern struts depending from the stern portion of the hull structure, a first buoyancy means subtended from said set of dual bow struts and connected to the struts at a fixed non-rotatable rotatable longitudinal inclination, and second buoyancy means subtended from said set of dual stern struts and connected to the struts at a fixed non-rotatable longitudinal inclination, said bow and stern sets of struts each having a length dimension from bow to stern determined by the formula $$F=\frac{v}{\sqrt{gl}}$$

where

F=design Froude number

V=design speed of the small waterplane area high speed ship in feet per second l=longitudinal length of the struts in feet g=acceleration due to gravity in feet per second squared and the design Froude number is 0.8 or greater, said buoyancy means providing the major buoyancy for the ship during operation to maintain said hull above the surface of the water in a generally level attitude, and wherein the first and second sets of struts are spaced longitudinally a predetermined distance selected such that the transverse wave created by the first set of struts is 180° out of phase from the transverse wave created by the second set of struts at the critical hump speed, the hull speed region at which a large increase in wave resistance occurs as a main or primary hump on a wave drag curve so as to result in a requirement for a maximum increase in propulsion power.

16. A small waterplane area high speed ship as defined in claim 15 wherein said predetermined distance is equal to an odd multiple of the water length of the struts.

17. A small waterplane area high speed ship according to claim 15 wherein said first buoyancy means includes a single transverse bow foil, said transverse bow foil being connected to each of said dual bow struts, the relationship between the longitudinal length of said transverse bow foil and the design speed of the ship being determined by the formula $$F=\frac{v}{\sqrt{gl}}$$

where

F=design Froude number

V=design speed of the small waterplane area high speed ship in feet per second l=longitudinal length of the struts in feet g=acceleration due to gravity in feet per second squared and the design Froude number is 0.8 or greater.

18. A small waterplane area high speed ship as defined in claim 17 wherein said second buoyancy means includes a transverse stern foil, said transverse stern foil being connected to each of said dual stern struts, the relationship between the longitudinal length of said transverse stern foil and the design speed of the ship being $$F=\frac{v}{\sqrt{gl}}$$

where

F=design Froude number

V=design speed of the small waterplane area high speed ship in feet per second l=longitudinal length of the struts in feet g=acceleration due to gravity in feet per second squared and the design Froude number is 0.8 or greater.

19. The small waterplane area high speed ship according to claim 15 wherein each of said bow struts also includes a bow buoyancy pod.

20. The small waterplane area high speed ship according to claim 18 wherein each of said stern struts also includes a stern buoyancy pod.

21. The small waterplane area high speed ship according to claim 19 wherein said bow buoyancy pods are respectively connected to and subtended from said dual bow struts, and with the longitudinal length of each of said first buoyancy pods having a relationship with the design speed of the ship as follows:

$$F=\frac{v}{\sqrt{gl}}$$

where

F=design Froude number

V=design speed of the small waterplane area high speed ship l=longitudinal length of the said buoyancy pods g=acceleration due to gravity in feet per second squared and the design Froude number is 0.8 or greater.

22. The small waterplane area high speed ship according to claim 20 wherein said stern buoyancy pods are respectively connected to and subtended from said dual stern struts, and with the longitudinal length of each of said stern buoyancy pods having a relationship with the design speed of the ship as follows:

$$F=\frac{v}{\sqrt{gl}}$$

where

F=design Froude number

V=design speed of the small waterplane area high speed ship l=longitudinal length of the said buoyancy pods g=acceleration due to gravity in feet per second squared and the design Froude number is 0.8 or greater.

23. A small waterplane area high speed ship comprising a hull structure having a bow portion and a stern portion and being normally supported above the surface of the water when in operation; a plurality of bow struts, said plurality of how struts depending from the bow portion of said hull structure, and at least one stern strut, said at least one stern strut depending from the stern portion of said hull structure first buoyancy means subtended from said plurality of bow struts and connected to the bow struts at a fixed, non-rotatable longitudinal inclination, and second buoyancy means subtended from said at least one stern strut and connected to the bow struts at a fixed, non-rotatable longitudinal inclination, the longitudinal length of each of said bow struts, said first buoyancy means, said stern strut and said second buoyancy means being determined by the formula $$F=\frac{v}{\sqrt{gl}}$$

where

F=design Froude number

V=design speed of the small waterplane area high speed ship in feet per second l=length of each of said bow struts, first set of buoyancy means, said stern struts and said second set of buoyancy means, in feet g=acceleration due to gravity in feet per second squared and the design Froude number is 0.8 or greater and wherein said bow and stern struts and said first and second buoyancy means are spaced apart by longitudinal distances which provide transverse wave drag cancellation at hump speed, the hull speed region at which a large increase in wave resistance occurs as a main or primary hump on a wave drag curve so as to result in a requirement for a maximum increase in propulsion power.

24. The small waterplane area high speed ship according to claim 23 wherein said first buoyancy means includes a single transverse bow foil connected between said bow struts and providing the major buoyancy for the bow of the ship to maintain said hull level and above the surface of the water during operation.

25. The small waterplane area high speed ship according to claim 24 wherein said second buoyancy means includes a single transverse stern foil connected to said at least one stern strut and providing the major buoyancy for the stern of the ship to maintain the hull level and above the surface of the water during operation.

26. A small waterplane area high speed ship as defined in claim 25 wherein said bow struts and said at least one stern strut are spaced longitudinally a predetermined distance selected such that the transverse wave created by the bow struts at said hump speed is 180° apart from the transverse wave created by the at least one stern strut.

27. A small waterplane area high speed ship as defined in claim 26 wherein said predetermined distance is equal to an odd multiple of the water length of the struts.

28. A small waterplane area high speed ship comprising a hull structure having a bow portion and a stern portion and being normally supported above the surface of the water when in operation; a plurality of bow struts, said plurality of bow struts depending from the bow portion of said hull structure, and at least one stern strut, said at least one stern strut depending from the stern portion of said hull structure, first buoyancy means subtended from said plurality of bow struts, and second buoyancy means subtended from said at least one stern strut, the longitudinal length of each of said bow struts, said first buoyancy means, said stern strut and said second buoyancy means being determined by the formula $$F=\frac{v}{\sqrt{gl}}$$

where

F=design Froude number

V=design speed of the small waterplane area high speed ship in feet per second l=length of each of said bow struts, first set of buoyancy means, said stern struts said second set of buoyancy means, in feet g=acceleration due to gravity in feet per second squared and the design Froude number is 0.8 or greater and wherein said first buoyancy means include a single transverse bow foil connected between said bow struts and providing the major buoyancy for the bow of the ship to maintain said hull level and above the surface of the water during operation and wherein said second buoyancy means include a single transverse stern foil connected to said at least one stern strut and providing the major buoyancy for the stern of the ship to maintain the hull level and above the surface of the water during operation and including means located between said bow and stern struts for creating destructive wave interference.

29. A small waterplane area high speed ship as defined in claim 28 wherein said means comprises a third pair of struts.

30. A small waterplane area high speed ship as defined in claim 29 wherein said third pair of struts have free bottom ends located below the design waterline of the ship and above the bottoms of said bow and stern struts.

31. A small waterplane area high speed ship comprising an above-water plane hull structure having a bow portion and stern portion, a first set of dual bow struts depending from the bow portion of the hull structure, a set of dual stern struts depending from the stern portion of the hull structure, first buoyancy means subtended from said set of bow struts, second buoyancy means subtended from said set of dual stern struts; said first buoyancy means comprising a first foil shaped element extending between and connected to said bow struts at a fixed, non-rotatable longitudinal inclination and said second buoyancy means comprising a second foil shaped element extending between and connected to said stern struts at a fixed, non-rotatable longitudinal inclination; said buoyancy means providing the major buoyancy for the ship during operation to maintain said hull above the surface of the water during operation of the ship; said bow and stern struts being spaced longitudinally a predetermined distance selected such that the transverse wave created by each is 180° out of phase at hump speed, the hull speed region at which a large increase in wave resistance occurs as a main or primary hump on a wave drag curve so as to result in a requirement for a maximum increase in propulsion power.

32. A small waterplane area high speed ship as defined in Claim 31 wherein said predetermined distance is equal to an odd multiple of the water length of the struts.

33. A small waterplane area high speed ship as defined in claim 32 wherein the length of the struts and foils is selected such that at the design operational speed of the vessel its Froude number is 0.8 or higher.

34. A small waterplane area high speed ship comprising an above-water plane hull structure having a bow portion and stern portion, a first set of dual bow struts depending from the bow portion of the hull structure, a set of dual stern struts depending from the stern portion of the hull structure, first buoyancy means subtended from said set of bow struts, second buoyancy means subtended from said set of dual stern struts; said first buoyancy means comprising a first foil shaped element extending between and connecting said bow struts and said second buoyancy means comprising a second foil shaped element extending between and connecting said stern struts; said buoyancy means providing the major buoyancy for the ship during operation to maintain said hull above the surface of the water during operation of the ship; said bow and stern struts being spaced longitudinally a predetermined distance selected such that the transverse wave created by each is 180° out of phase at hump speed, the hull speed region at which a large increase in wave resistance occurs as a main or primary hump on a wave drag curve so as to result in a requirement for a maximum increase in propulsion power, and wherein said predetermined distance is equal to an odd multiple of the water length of the struts and wherein the length of the struts and foils is selected such that at the design operation speed of the vessel its Froude number is 0.8 or higher, and including means located between said bow and stern struts for creating destructive wave interference.

35. A small waterplane area high speed ship as defined in claim 34 wherein said means comprises a third pair of struts.

36. A small waterplane area high speed snip as defined in claim 35 wherein said third pair of struts have free bottom ends located below the design waterline of the ship and above the bottoms of said bow and stern struts.

37. A small waterplane area ship according to claim 36 wherein said first buoyancy means includes buoyancy pods on each of said bow struts.

38. A small waterplane area ship according to claim 36 wherein said second buoyancy means includes buoyancy pods on each of said stern struts.

39. A small waterplane area ship according to claim 36 wherein said first and second buoyancy means include buoyancy pods on each of said struts.

* * * * *